US006053224A

United States Patent [19]

Hellgren et al.

[11] Patent Number: 6,053,224

[45] Date of Patent: Apr. 25, 2000

[54] DEVICE FOR PRESSURE TREATMENT OF WOOD

[75] Inventors: Keijo Hellgren; Tom Johannisson, both of Västerås, Sweden

[73] Assignee: Asea Brown Boveri AB, Vasteras, Sweden

[21] Appl. No.: 08/930,137

[22] PCT Filed: Apr. 12, 1996

[86] PCT No.: PCT/SE96/00485

§ 371 Date: Jan. 29, 1998

§ 102(e) Date: Jan. 29, 1998

[87] PCT Pub. No.: WO96/32236

PCT Pub. Date: Oct. 17, 1996

[30] Foreign Application Priority Data

Apr. 13, 1995 [SE] Sweden ..... 9501427

[51] Int. Cl.[7] ..... B27M 1/02

[52] U.S. Cl. ..... 144/361; 144/364; 144/380; 144/271

[58] Field of Search ..... 144/259, 269, 144/271, 361, 364, 380, 256.7, 254

[56] References Cited

U.S. PATENT DOCUMENTS

| | | | |
|---|---|---|---|
| 2,567,292 | 9/1951 | Lundstrom | 144/380 |
| 2,793,859 | 5/1957 | Darling et al. | 144/380 |
| 3,621,897 | 11/1971 | Vazzola et al. | 144/364 |
| 4,017,980 | 4/1977 | Kleingventher | 144/380 |
| 4,116,252 | 9/1978 | Ikeda | 144/380 |
| 4,428,410 | 1/1984 | Strandberg | 144/361 |
| 5,190,088 | 3/1993 | Thomassen et al. | 144/380 |
| 5,247,975 | 9/1993 | Tanahashi et al. | 144/380 |
| 5,678,618 | 10/1997 | Lindhe et al. | 144/380 |

FOREIGN PATENT DOCUMENTS

| | | |
|---|---|---|
| 0 460 235 A1 | 12/1991 | European Pat. Off. . |
| 7805483 | 11/1979 | Sweden . |
| 432 903 | 9/1984 | Sweden . |
| 446 702 | 10/1986 | Sweden . |
| 452 436 | 11/1987 | Sweden . |
| 100 792 | 12/1916 | United Kingdom . |
| 233 778 | 5/1925 | United Kingdom . |
| WO 95/13908 | 5/1995 | WIPO . |

*Primary Examiner*—W. Donald Bray
*Attorney, Agent, or Firm*—Pollock, Vande Sande & Amernick

[57] ABSTRACT

A device for pressure treatment of wood elements comprises a pressure chamber for accommodating the wood elements which are to be treated. The pressure chamber also accommodates a pressure medium which surrounds the wood elements on more than one side and, at least before the pressurization, a secondary medium in the form of a fluid. When the pressure medium is pressurized, the wood elements are subjected to a multilateral pressure, whereby they are permanently compressed. Furthermore, the pressure chamber is provided with elements for controlling the quantity of secondary medium which penetrates into the wood during the treatment. These elements may include evacuating valves or casings which surround the wood elements and which are impenetrable to the secondary medium.

12 Claims, 1 Drawing Sheet

DEVICE FOR PRESSURE TREATMENT OF WOOD

TECHNICAL FIELD

The present invention relates to a device for pressure treatment of wood. The device comprises a treatment space in the form of a pressure chamber, which during the pressure treatment accommodates one or more wood elements and a pressure medium for transferring the pressure to the wood elements, the pressure medium surrounding the wood elements on more than one side.

The device is especially suitable for hardening-treatment of elongated plane wood elements, such as boards sheets and plates.

BACKGROUND OF THE INVENTION

It is previously known to change the properties of wood products by pressure treatment. SE 446 702 describes one method for hardening and stabilizing wood. The method comprises heating the wood to a temperature of 75–160° C. and compressing it by mechanical pressing at a compression pressure of 50–1000 bar for 0.1–60 seconds. For carrying out this treatment, a roller press is used. However, it has proved that this method leads to an uneven treatment result. The change in hardness of the treated wood varies markedly between various points on the treated surface. This insufficient treatment result is primarily connected with disadvantages of the roller press. During calendering, the treatment pressure is applied along a line on the surface of the treated element. The calendering means that small natural variations in the thickness and density of the untreated wood element result in different local roll pressures. Thus, also the treatment result varies locally. Furthermore, calendering results in the pressure being applied in only one direction. During the rolling, therefore, the treated element tends to float out in breadth and in length. This results, among other things, in the edges of the element becoming uneven. Still worse, however, is that the unidirectional pressure contributes to the locally varying treatment result. The material in those parts of the element which are located along the edges of the element easily floats out and only experiences the vertical compression. In those parts which are not situated at the edge, on the other hand, the internal friction of the wood prevents the material from floating out. The material in these parts therefore experiences also a certain and greatly varying internal horizontal counter-pressure, which leads to making these parts harder than at the edges of the element. It is primarily the locally varying hardness result that makes calendering unsuitable for pressure treatment of wood elements.

Swedish patent application 7805483-0 describes a method for pressing veneer. The description states that it is known to press veneer at moderate pressures of about 1–5 MPa and also that it has proved to be suitable, when pressing pine wood veneer, to work with pressures around 150–350 MPa. According to this document, the pressure should be applied by means of a hydraulic press across the whole veneer surface simultaneously. These statements would seem to be unreasonable to a person skilled in the art. Generating such high pressures over such large surfaces with prior art technique would seem to be, if not impossible, at least commercially unrealizable. It is more likely that the pressures intended throughout the description are to be given in the unit bar, that is, that the actual pressures intended are one-tenth of those given in MPa in the description.

With this interpretation, the description becomes more reasonable and then addresses a problem which is associated with pressing of veneer. It describes how pine wood veneer, which is pressure-treated in a mechanical surface press or roller press, tends to be crushed and pulverized when the surface pressure exceeds 350 bar. This phenomenon, which of course is undesired, is due to the fact that the pressure is applied in one direction only.

Also SE 432 903 relates to a method for hardening wood by compressing flat wood elements. When carrying out the method, the wood element is placed in a treatment space, between two press devices which are movable relative to each other. Between the wood element and one of the press devices, there is further placed an elastic material layer, made of plastic or rubber. During the treatment, the wood element is compressed in one single treatment step by moving the press devices against each other to a desired mutual distance and thereafter moving them away from each other. During the compression, hard twigs force their way out of the wood element and into the elastic material layer, which counteracts splitting of the hard twigs. The treatment is to result in a permanent compression of the wood element without twigs being crushed, thus without deteriorating the quality of the treatment element.

However, it has proved that also this method results in a varying increase of the hardness in different parts of the treated element. Admittedly, the device for carrying out the method comprises, in addition to the two press devices, also two longitudinal side limiting strips. The task of these strips is probably to prevent the wood element from moving laterally during the treatment. In addition, the strips probably, to a certain extent, prevent the wood element from moving out laterally during the compression. Still, the fact remains that also this press device is only able to generate a pressure in one direction. As indicated in SE 432 903, this entails a limitation since the treatment pressure according to the document should not exceed 50 MPa or 500 bar. For pine wood, the pressure should not exceed 400 bar, which corresponds well to the problem mentioned in 7805483-0, that is, that pine wood veneer tends to be crushed when the treatment pressure exceeds 350 bar.

The devices described above for pressure treatment of wood thus all suffer from two serious defects. On the one hand, pressure treatment by means of these devices leads to a treatment result which varies over the surface of the treated element, and, on the other hand, the devices entail a limitation with respect to a relatively low maximum pressure, which can be used without damaging the wood to be treated.

The latter limitation is particularly serious since it has been found recently that higher treatment pressures, if they do not damage the wood, lead to a considerably better treatment result as regards hardening and compression stability.

GB 100,792 describes a method for pressure treatment of wood in which the treated wood is placed in a pressure medium and is subjected to a multilateral pressure, which is transferred to the wood via the pressure medium. The multilaterally applied pressure reduces the risk of crushing the pores of the wood during the treatment. For the method to function, it is required that no gas or liquid, which may be accommodated in the pressure medium, is allowed to penetrate into the wood during the pressure treatment. For that reason, the method is carried out with a specially viscous pressure medium, which is completely free from gases. Alternatively, the wood to be treated may be enclosed in an elastic material which is completely impenetrable to gas. A further condition for the method to function is that the pressure treatment is carried out at an elevated temperature which is above 90° C. To this end, special heating members are arranged around the pressure chamber.

Although the method described in GB 100,792 entails a smaller risk of the pores of the wood being damaged during the treatment, it also has a number of disadvantages. For example, the method only permits the wood to be pressurized to a pressure of about 200 bar. In addition, it is required that the pressure treatment proceeds for a considerable period of time of about 2 to 3 hours. Further, the method also makes very special demands on the pressure medium being used, since this should be completely free from gas or liquid which may penetrate into the wood. Perhaps a still more serious limitation of the described method is that it requires special heating means, since the pressure treatment cannot be carried out at normal room temperature.

The object of the present invention is therefore to provide a device for pressure treatment of wood, by means of which the pressure treatment of the wood can be carried out with a satisfactory result in a considerably shorter time, whereby the wood can be pressurized at normal room temperature to pressures of more than 800 bar.

THE SUMMARY OF THE INVENTION

The above-mentioned object is achieved according to the invention with a device of the kind mentioned in the introductory part. This which device is characterized in that the pressure chamber at least prior to the pressurization also receives a secondary medium in the form of a fluid, and that it includes means for controlling the quantity of secondary medium which, during the pressurization, penetrates into the wood.

By controlling the quantity of secondary medium which penetrates into the wood during the pressurization, it is possible, among other things, to locally control the temperature of the pressure medium and of the wood. In the cases where the secondary medium consist of a compressible gas or liquid, the temperature of the medium is raised during the compression, whereby the control of the quantity of penetrating medium may be used for accurate temperature control. This temperature control is particularly useful for achieving and influencing certain chemical changes in the wood during the treatment. The device thus makes possible an accurate temperature control completely without the need of special heating and cooling means. This completely eliminates the cost of such means. At the same time, the operating cost when using the device according to the invention is reduced since no separate heating energy needs to be added. The means for control of that quantity of secondary medium which penetrates into the wood can also be used to completely exclude penetration of secondary medium during the pressure treatment. In this way it is possible to use one and the same device both for applications where penetration of a medium is desirable and for applications where penetration of a medium should be avoided.

The device also makes possible impregnation of the wood during the pressure treatment. The secondary medium may contain preserving and impregnating agents. In this way it is possible, in one and the same treatment step, to compress and harden as well as impregnate the treated wood.

Since the pressure medium surrounds the element on more than one side, it is possible to subject the wood element to a multilateral pressure. The pressure medium transfers the same pressure to all the sides of the element which are surrounded by the pressure medium so it is possible to prevent the material from floating out in any direction. Further, each part of the element, regardless of thickness and density, will be subjected to the same pressure, which means that the whole element undergoes the same change of properties, for example in the form of hardening. In addition, the multilateral pressure results in the advantage that a considerably higher pressure can be used than what is possible with presses of the previously used kind. Tests have shown that pine wood has been treated with a pressure exceeding 1000 bar without the wood having been crushed or otherwise damaged.

The means for control of the quantity of penetrating secondary medium may comprise one or more valves for evacuation of secondary medium from the pressure chamber. The means allow the wood elements to be placed in the pressure chamber at atmospheric pressure and, for example, that air from the surroundings is present in the pressure chamber when the pressure treatment is started. During the pressure build-up in the pressure chamber, the valves are opened so that the gas is evacuated. Since only the desired residual quantity of gas is found in the pressure chamber, the valve is closed, whereupon the pressure treatment may be completed while gas penetrates into the wood. During the decompression, the valves may again be opened, causing gas to flow into the pressure chamber to avoid the build-up of vacuum.

The means for control of the penetration of secondary medium may also comprise a casing which surrounds each wood element and is impenetrable to the secondary medium. The casing includes, for example a plastic bag, into which the wood elements are inserted prior to the treatment. Prior to the pressure treatment, the bag is also sealed, for example by welding or shrinkage by heating. The wood elements thus tightly delimited may thereafter be pressurized in the pressure chamber, even if this contains a gas or a liquid of a kind and in a quantity which is not desired to penetrate into the elements during the treatment. By allowing a certain quantity of gas or liquid to be enclosed in the casing when the bag is sealed, the quantity of gas or liquid penetrating into the wood element may be controlled. A combination of valves and surrounding casings is also possible.

The device according to the invention may be designed so that the pressure medium surrounds the wood element on all sides. The pressure medium may then during the pressurization transfer the same high pressure to all the sides of the element. In this way, the wood element is subjected to a completely isostatic pressure, that is, a pressure which is equal in all directions in space. Pressure treatment of wood under complete isostatic pressure is advantageous from several points of view. For one thing, the isostatic treatment results in the equilateral compression of the wood element. If, for example, a board with a rectangular cross section which has a definite ratio between the various sides of the cross section is pressurized isostatically, the ratio between the sides will be the same after the treatment, whereas the area of the cross section has decreased permanently. The length of the board is not influenced to the same extent by the pressure treatment. An additional advantage with complete isostatic treatment, compared with other multilateral pressurization, and especially compared with unilateral pressurization, is that the maximum treatment pressure may be maintained considerably higher without damaging the wood. A high treatment pressure is often desirable, since it has been found that the treatment result, for example in the form of hardening and a change in elasticity of the wood, is improved at an elevated pressure.

Further, the device according to the invention may comprise one or more guide surfaces which contact the wood elements during the treatment. During a complete isostatic treatment of, for example, elongated wood elements, the element sometimes tends to undergo a certain torsion. Even if the cross section of the element is compressed uniformly, the pressure treatment may thus result in a unwanted deformation along the longitudinal axis of the element. By allowing the element to make contact with a guide surface with one of its long sides, this torsion is avoided.

The guide surfaces may be designed in a number of different ways. For example, the bottom of the pressure chamber may have a common guide surface for a plurality of wood elements placed adjacent to each other. Further, the guide surfaces may include of a plurality of stiff beams arranged adjacent to and above one another. In addition, it is possible for the guide surfaces to be shaped for embossing a pattern in the side of the wood element making contact with the guide surface. Thus, the guide surfaces need not necessarily be plane but may exhibit different profiles and geometries.

Further, in the device according to the invention, the guide surfaces may be coated with a friction-changing layer. If the wood element during the pressure treatment makes contact with a guide surface, the contact side of the element tends to become compressed to a lesser extent than those sides which are surrounded by the pressure medium. Thus, the wood element will be non-uniformly compressed, so that the cross section of the element, which was rectangular from the start, after the treatment exhibits the shape of a trapezium or, more particularly, a truncated triangle, where the side making contact with the guide surface is longer than the opposite side. The phenomenon, which in certain cases is unwanted, arises because of the friction between the wood element and the guide surface. By coating the guide surfaces with a friction-reducing layer, it is possible to reduce this friction so that the ratio between the different sides of the cross section is essentially maintained during the compression. Inversely, it is also possible to coat the guide surfaces with a friction-increasing layer to strengthen the non-uniform compression effect, if this should be desired. By choosing different friction-changing layers, it is thus possible to control to what extent the cross section of the wood element is to be compressed non-uniformly when making contact with a guide surface during the pressure treatment.

In the device according to the invention, the pressure medium may include a flexible material, preferably rubber, which in the high-pressure chamber is separated from a working fluid with a diaphragm. To prevent penetration of the pressure medium into the wood during the treatment, the pressure medium should not have too low viscosity. At the same time, the internal friction of the pressure medium must not be too high in order for the medium to be able to generate an isostatic pressure in the pressure chamber. The medium may thus be flexible and rubber has proved to be especially preferably. The rubber is suitably shaped as a plurality of elements with a suitable size and shape. To transmit the pressure from a pressure-generating unit, a working fluid in the form of a liquid or a gas is used. Such working fluids can be pressurized, relatively simply, in the usual manner by means of a pump, a hydraulic unit, a pressure intensifier, or in some other way. Further, to prevent the working fluid from mixing with the pressure medium and running the risk of penetrating into the wood element, working fluid and pressure medium are separated by an elastic diaphragm. This diaphragm is arranged in the pressure chamber and divides the chamber, during the pressurization, into a primary chamber which accommodates the working fluid and a secondary chamber which accommodates the wood element and the pressure medium. The elasticity of the diaphragm ensures that the pressure medium may form itself and surround the wood element on all the intended sides.

In the device according to the invention, the pressure medium may alternatively be a liquid. Since a liquid is pressurized in a simple manner by means of the pressure-generating means described above, no separate working fluid is needed in this embodiment. Nor is any diaphragm for dividing the pressure chamber into a primary and a secondary chamber needed. To prevent the liquid pressure medium in this embodiment from penetrating into the wood, the wood elements may be surrounded by a casing to prevent contact between the liquid and the wood. This casing is preferably used also to enclose the quantity of gas which, where appropriate, is intended to penetrate into the wood during the pressurization. Such casings may, for example, be designed as liquid-tight bags or as a shrunk-on and/or welded wrapping foil. The casing is preferably made of some plastic material.

The device is preferably adapted to carry out the pressure treatment at temperatures between 0 and 50° C., preferably between 10 and 40° C. It is thus possible to use the device at normal room temperature or even outdoors, without having to use any special heating means. In those cases where the pressure treatment requires a certain minimum local temperature in the wood during the treatment, this temperature is obtained and controlled by control of the quantity of secondary medium, in the form of a compressible medium which penetrates into the wood during the pressurization.

Further, the device is adapted to carry out the pressure treatment at pressures of between 500 and 5000 bar, preferably between 800 and 1500 bar. Because of the multilateral pressure and the controlled penetration of secondary material, it is possible to pressurize the wood to these relatively high pressures without damaging the wood. During experiments, the above-mentioned pressure intervals have proved to provide good results during treatment of different kinds of wood.

BRIEF DESCRIPTION OF THE DRAWING

Exemplifying embodiments of the invention will be described below with reference to the accompanying drawings, wherein.

DETAILED DESCRIPTION OF THE PREFERRED EMBODIMENT(S)

Figure 1:
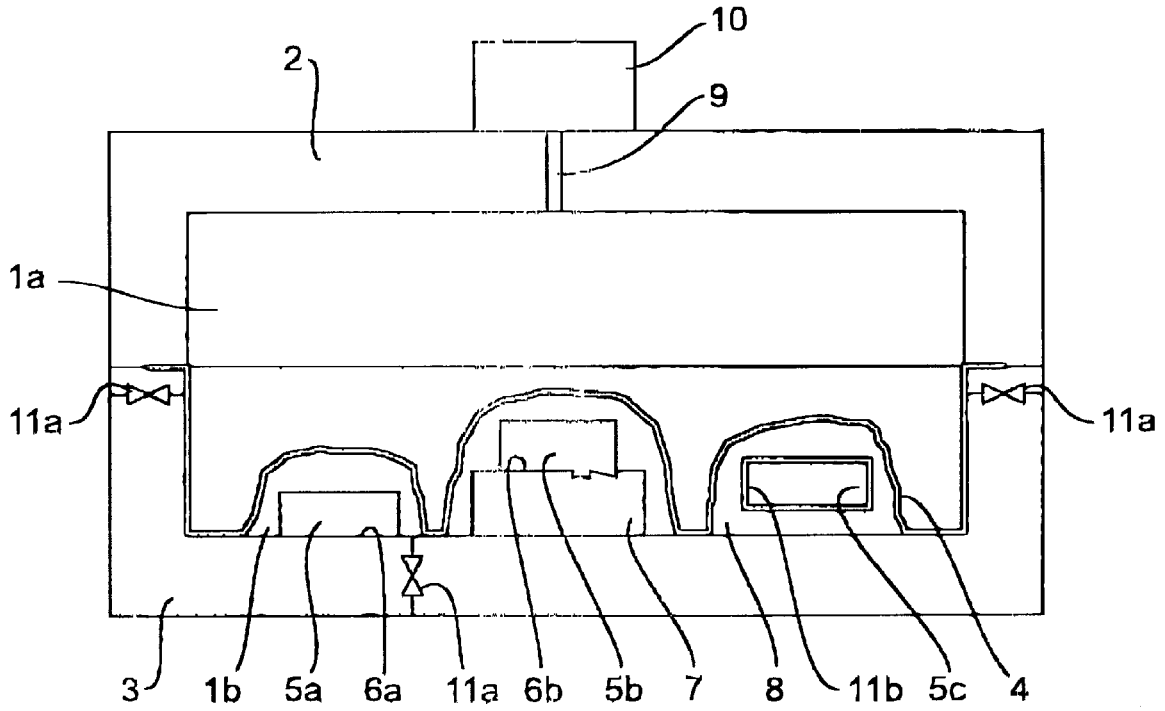
FIG. 1 is a schematic cross section through a device for pressure treatment of wood according to one embodiment of the invention.

The device for pressure treatment of wood shown in FIG. 1 comprises a pressure chamber 1, which is defined by an upper part 2 and a lower part 3. By separating the two parts 1 and 2, the pressure chamber is opened, thus providing a possibility of inserting and withdrawing the wood elements which are being treated. In the pressure chamber 1 an elastic diaphragm 4 is arranged. The diaphragm 4 is attached to the upper part 2 so that it is fixed between the upper part 2 and the lower part 3 when the pressure chamber 1 is closed and so that the lower part 3 of the pressure chamber is exposed when the chamber is opened. When the pressure chamber 1 is closed, the diaphragm delimits the pressure chamber into one primary compartment 1*a* and one or more (three in the figure) secondary compartments 1*b*. The diaphragm 4 is in the form of a rubber cloth, but also other materials may be used.

The pressure chamber 1 further accommodates three elongated wood elements 5*a*, 5*b*, 5*c*. The first wood element 5*a* is placed on the bottom of the pressure chamber and makes contact, at its lower long side, with the lower part 3 of the pressure chamber, which lower part thus forms a plane guide surface 6*a* for the first element 5*a*. The second wood element 5*b* is placed on a separate guide surface 6*b* which is arranged on a beam 7. Further, the beam 7 is formed as an embossing tool, where its cross section exhibits a certain profile, so that the guide surface 6*b* is not plane but provided with recesses corresponding to the desired shape of the cross section of the wood element 5*b* after the treatment. The third wood element 5*c* is gas-tightly enclosed in a plastic casing 11*b*. This casing 11*b*, includes a plastic hose which is fitted onto the wood element 5*c* and welded together at its ends, and prevents any remaining gas in the pressure chamber from penetrating into the wood element during the pressure treatment. It is also possible to weld the plastic hose with a certain definite quantity of remaining gas enclosed in the casing. In this way the quantity of gas, which during the pressure treatment penetrates into the wood element, is controlled. The third wood element 5*c* does not make contact with any guide surface but is freely embedded in a pressure medium 8. Also the other two wood elements 5*a*, 5*b* are embedded in the pressure medium 8, so that the medium surrounds the elements on all the sides except those which make contact with the guide surfaces 6*a* and 6*b*, of the element. The pressure medium 8 consists of a plurality of adapted rubber elements. These elements may be shaped in a plurality of different ways; they may, for example, be shaped as balls, elongated strips, cubes, or as non-uniform larger or smaller bodies.

A pressure pipe 9 opens into the pressure chamber 1 above the diaphragm 4 and connects a pressure-generating hydraulic unit 10 to the primary compartment 1*a* of the pressure chamber 1. Via the pressure pipe, a pressurized working fluid in the form of hydraulic oil may be supplied to the primary compartment 1*a* of the pressure chamber. Also other working fluids, such as water or gas, may, of course, be used.

Further, at the lower part 3 of the pressure chamber, three evacuating valves 11*a* are arranged. The valves may be pressure-controlled or controlled in some other way.

When the wood elements 5*a*, 5*b*, 5*c* are to be pressure-treated, the pressure chamber 1 is first opened by separating the two parts 2 and 3. The diaphragm 4, which at this stage is relatively stretched, accompanies the upper part. The lower part 2 of the chamber 1 is thus exposed and the first 5*a* and second 5*b* wood elements may be placed on their guide surfaces 6*a* and 6*b*, respectively. The third wood element is placed on a small heap of accumulated pressure medium 8. Thereafter, pressure medium 8 is applied across the wood elements 5*a*, 5*b*, 5*c* so that they are completely covered. The upper part of the pressure chamber is placed in position and secured with the lower part 3 so that the chamber 1 becomes tight. At the same time, the diaphragm 4 is squeezed between the upper and lower parts 2 and 3.

When the pressure chamber 1 is sealed, the pressure may build up. The hydraulic unit 10 pumps oil via the pressure pipe 9 into the primary compartment 1*a* of the pressure chamber 1. When this compartment is successively filled with oil, the diaphragm 4 is stretched out more and more. This causes the volume of the secondary compartment 1*b* below the diaphragm 4 to decrease. As the diaphragm 4 is stretched and forms around the pressure medium 8 in the secondary compartment 1*b*, the remaining air is evacuated via the valves 11*a* from the secondary compartment 1*b*. In this way, air in the secondary compartment 1*b* is prevented from penetrating into the wood elements 5*a*, 5*b*. By controlling the valves, it is possible to intentionally maintain a certain quantity of air in the secondary compartment. For certain applications, it may be desirable to have a certain air penetration into the wood during the pressure treatment. Since the temperature of the gas is raised during the compression, the quantity of remaining gas may be used for controlling the change of temperature which occurs in the wood elements and in the pressure medium during the pressure treatment. An increase in temperature may in certain applications be desirable, for example if it is desired to achieve or influence certain chemical reactions in the wood during the treatment. As an example it may be mentioned that the substance lignin included in the wood is changed positively under the influence of elevated pressure and temperature. Further, the valves may be used also for introducing other substances, such as impregnating gases or liquids, into the secondary compartment before or in the course of the pressure treatment. These gases or liquids may then be enclosed in the secondary compartment 1*b* of the pressure chamber by closing the valves 11*a*, and be caused to penetrate into the wood by means of pressurization of the pressure chamber.

When the diaphragm 4 closes around the pressure medium, the actual pressurization of the pressure medium sets in. The hydraulic unit 10 is now brought to supply additional hydraulic oil to the primary compartment 1*a*. This results in build-up of a pressure in the pressure chamber which is just as large in the primary as in the secondary compartment. The pressure in the pressure chamber is essentially isostatic, or hydrostatic. That is to say, at each point in the pressure chamber, a pressure prevails which is essentially equal in all the directions of space. The pressure of the working fluid is transferred to the pressure medium 8, which in turn transfers it to all the sides of the wood elements 5*a*, 5*b*, 5*c*. In a device according to the invention, wood elements may be pressurized with pressures up to 15,000 bar. During experiments, pressures of between 1,000 and 5,000 bar have proved to provide certain interesting result. Normal pressures, for example for treatment of pine wood, however, are between 800 and 1,500 bar, especially between 1,000 and 1,200 bar.

FIG. 1 shows the device with wood elements when maximum treatment pressure prevails in the pressure chamber 1. During the pressure treatment, all the wood elements receive a permanent compression, with an associated increase in density and hardness. However, the different wood elements react somewhat differently depending on their mutual different locations and embedments. The first wood element 5*a* undergoes a somewhat non-uniform compression. Depending on the friction between the guide surface 6*a* and the lower contact surface of the element, the upper part of the cross section is compressed somewhat more than that part which makes contact with the guide surface 6*a*. This is due to the fact that the friction prevents the lower surface material of the element from moving towards the center of the lower side. By reducing the friction between the guide surface and the wood element, it is possible to reduce the degree of non-uniformity of the compression. The friction may be reduced, for example by coating the guide surface 6*a* with a friction-reducing layer, for example with polymers such as Teflon or with liquid lubricants, such as different oils. It is also possible to influence the friction by making the guide surface of a highly polished material or treating the wood element in a friction-reducing manner.

Also the second wood element 5*b* receives a permanent compression during the pressure treatment. In addition, this element will penetrate down into the profiled recesses which are provided in the guide surface 6*b* of this element. This causes the wood element 5*b* to be embossed and a certain profile to be imparted thereto while at the same time the material is rendered hard. Such embossing is suitably used, for example, when shaping molding strips, linings and skirtings. The embossing results in a considerable saving from the points of view of economy and time, since a subsequent milling or planing is often not necessary. Also the guide surface of this element may be provided with a friction-reducing layer to improve the result of the shaping.

The third element 5*c* is completely surrounded by pressure medium 8 during the pressurization. The element is compressed essentially uniformly, so that its cross-section area is reduced whereas the ratio between the sides of the cross section is retained. By choosing pressure media with different viscosity and internal friction, it is possible to control the degree of isostatic pressure and hence to influence the uniformity of the compression. Different pressure media with different viscosity and internal friction are then placed on different sides of the wood element.

It should be noted that the figure only schematically shows a device according to the invention. In practice, the different types of guide surfaces and embedments are seldom mixed.

After the treatment pressure has been attained and maintained for a certain holding time, the wood elements are decompressed. The holding time may vary between one or a few tenths of a second and a few minutes. Usually it is sufficient with a holding time of 0.1–10 seconds. During the decompression, the working fluid is brought out of the primary compartment 1*a* of the pressure chamber 1. To prevent building up a vacuum in the secondary compartment 1*b*, the valves 11*a* are again opened, allowing air from the surrounding to flow in. When a sufficiently small quantity of the working fluid is present above the diaphragm, the upper and lower parts of the pressure chamber may be separated and the finished wood elements may be exposed and lifted out of the device.

Figure 2:
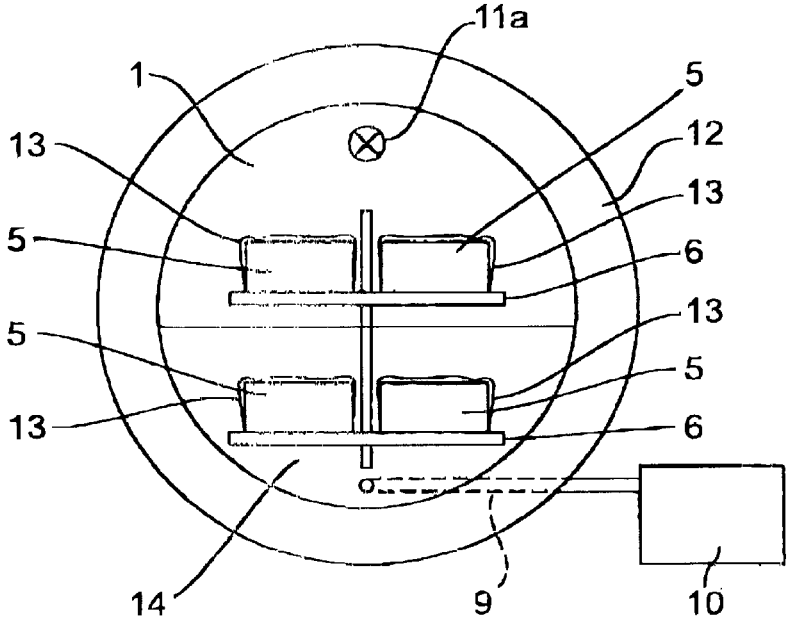
FIG. 2 is a schematic cross section through a device according to another embodiment of the invention.

FIG. 2 shows another embodiment of a device according to the invention. The device comprises a cylindrical pressure chamber 1. It is surrounded by a cylindrical element 12, which at each end is sealed by means of an end member (not shown). The pressure chamber 1 may be opened by removing one of or both of the end members. The pressure chamber communicates through a pressure pipe 9 with a pressure-generating unit 10. Further, an evacuating valve 11*a* is arranged in the end member 12. In the pressure chamber 1, two stiff guide surfaces 6 are arranged one above the other. These guide surfaces are each adapted to support two wood elements 5. The wood elements 5 consist of elongated boards with an essentially rectangular cross section. Further, each wood element is surrounded by a tight-fitting casing 13. The casing 13 is in the form of, for example, a plastic bag which, prior to loading the elements in the pressure chamber 1, is fitted onto the elements and sealed by means of welding. In those cases where a certain penetration of a gas or a liquid into the wood is desirable, the casing is filled with a corresponding quantity of gas or liquid before the sealing.

The elements 5 are loaded into the pressure chamber 1 via the opened end member when no pressure medium is present in the pressure chamber 1. After the pressure chamber 1 has been sealed, a pressure medium 14 is pumped, from the unit 10 and via the pressure pipe 9, into the pressure chamber. This pressure medium consists of a liquid, such as hydraulic oil or water. Alternatively, the liquid may be replaced by a gas. While the pressure medium is being pumped into the pressure chamber 1, the valve 11*a* is open for evacuation of air. FIG. 2 shows the device when the pressure medium is being pumped in. When the medium fills the pressure chamber 1, the valve 11*a* is closed, whereupon the pressurization occurs with the aid of the unit 10. During the pressure treatment, when the wood elements 5 are below the liquid surface, the wood is protected from contact with liquid by the tight-fitting casing 13. In the same way as in the example above, the uniformity of the compression of the elements may be influenced by influencing the friction between the wood elements 5 and the guide surfaces 6. For example, the tight-fitting casings 13 may be made of a material with advantageous anti-friction properties.

The pressure treatment is carried out with essentially the same pressures and holding times as stated above. After the holding time has been reached, the pressure medium 14 and the wood elements 5 are decompressed. When the pressure has dropped sufficiently, the valve 11*a* is opened to avoid the build-up of vacuum when pumping out the pressure medium. When the pressure chamber is emptied of pressure medium, the chamber is opened whereupon the finished wood elements are removed from the pressure chamber and stripped of their casings 13.

The invention is not, of course, limited to the embodiments described above, but may be varied within the scope of the appended claims.

For example, the pressure medium for transferring the pressure to the wood elements may consist of a diaphragm. In this embodiment the pressure medium (8), shown in FIG. 1, in the form of a plurality of rubber elements is eliminated and the pressure is transferred from the hydraulic unit, via the working fluid and the diaphragm, directly to the wood elements. The diaphragm is then of such an elastic nature that, during the pressurization, it is able to surround and make close contact with several of the sides of the wood elements.

We claim:

1. A device for pressure treatment of wood comprising:

a treatment space forming a pressure chamber for accommodating, during the pressure treatment, one or more wood elements; a pressure medium for transferring the pressure to the wood elements on at least one side, a secondary medium in the form of a fluid also accommodated in the pressure chamber, at least before the pressurization, and means for controlling the quantity of secondary medium which, during the pressure treatment, penetrates into the wood, said controlling means comprising at least one valve for evacuation of the secondary medium from the pressure chamber, wherein a quantity of the secondary medium which is to penetrate into the wood is selected by closing the at least one valve when appropriate quantity of secondary medium is present in the pressure chamber during pressure treatment.

2. A device according to claim 1, wherein the means for controlling the penetration of the secondary medium comprise a casing, surrounding each wood element and being impenetrable to the secondary medium, and wherein the quantity of secondary fluid which is to penetrate into the wood is selected by enclosing, before the pressure treatment, an appropriate quantity of secondary medium in the casing.

3. A device according to claim 1, wherein the pressure medium surrounds the wood elements on all sides.

4. A device according to claim 1, further comprising at least one guide surface with which the wood elements make contact during the treatment.

5. A device according to claim 5, wherein guide surfaces are coated with at least one friction-changing layer, which reduces or increases the friction between the wood elements and the respective guide surface.

6. A device according to claim 1, wherein the pressure medium is a flexible medium which, in the high-pressure chamber, is separated from a working fluid with a diagram.

7. A device according to claim 1, wherein the pressure medium is a liquid.

8. A device according to claim 1, wherein the device is adapted to carry out the pressure treatment at temperatures between 0 and 50° C.

9. A device according to claim 1, wherein the device is adapted to carry out the pressure treatment at pressure between 500 and 5000 bar.

10. A device according to claim 6, wherein said flexible medium includes rubber.

11. A device according to claim 8, wherein said temperatures are between 10 and 40° C.

12. A device according to claim 9, wherein said pressure is between 800 and 1500 bars.

* * * * *

UNITED STATES PATENT AND TRADEMARK OFFICE

CERTIFICATE OF CORRECTION

PATENT NO : 6,053,224
DATED : April 25, 2000
INVENTOR(S) : Keijo Hellgren

It is certified that errors appear in the above-identified patent and that said Letters Patent are hereby corrected as shown below:

Section [73], the Assignee, on the front cover of the Issued Patent, "Asea Brown Boveri AB, Vasteras, Sweden" should read -- Flow Holdings GmbH (SAGL) Limited Liability Company, Lugano, Switzerland --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,053,224
DATED : April 25, 2000
INVENTOR(S) : Keijo Hellgren and Tom Johannisson It is certified that error appears in the above-identified patent and that said Letters Patent is hereby corrected as shown below:

Title page,
Item [73], Assignee, "Asea Brown Boveri AB, Vasteras, Sweden" should read
-- Flow Holdings GmbH (SAGL) Limited Liability Company, Lugano, Switzerland --.

This Certificate supercedes Certificate of Correction issued May 22, 2001.

Signed and Sealed this

Twentieth Day of November, 2001

*Attest:*

Nicholas P. Godici

NICHOLAS P. GODICI
*Acting Director of the United States Patent and Trademark Office*

*Attesting Officer*